US005833368A

United States Patent [19]

Kaufman

[11] Patent Number: 5,833,368

[45] Date of Patent: Nov. 10, 1998

[54] PULL TAB OPENING SYSTEM FOR BEVERAGE CONTAINER

[75] Inventor: Richard Harry Kaufman, Chappaqua, N.Y.

[73] Assignee: Kraft Foods, Inc., Northfield, Ill.

[21] Appl. No.: 873,816

[22] Filed: Jun. 12, 1997

[51] Int. Cl.[6] ..... B65D 33/36

[52] U.S. Cl. ..... 383/205; 383/81; 383/202; 383/203; 426/123

[58] Field of Search ..... 383/205, 202, 383/200, 203, 207–209, 5, 78, 81; 206/807; 229/103.1, 123.1; 426/123

[56] References Cited

U.S. PATENT DOCUMENTS

| | | | |
|---|---|---|---|
| 3,453,661 | 7/1969 | Repko | 383/205 X |
| 3,552,631 | 1/1971 | Fuchs | 229/123.1 |
| 3,711,011 | 1/1973 | Kugler | 383/203 |
| 3,770,185 | 11/1973 | Reeves | 229/103.1 X |
| 4,244,474 | 1/1981 | Wise . | |
| 4,553,693 | 11/1985 | Terajima et al. . | |
| 4,679,693 | 7/1987 | Forman . | |
| 4,811,848 | 3/1989 | Jud | 383/205 |
| 4,838,429 | 6/1989 | Fabisiewicz et al. . | |
| 5,201,459 | 4/1993 | Bettle . | |
| 5,366,087 | 11/1994 | Bane | 383/81 X |
| 5,425,583 | 6/1995 | Wild . | |
| 5,582,889 | 12/1996 | Pedrini | 383/81 X |

*Primary Examiner*—Jes F. Pascua
*Assistant Examiner*—Robin A. Hylton
*Attorney, Agent, or Firm*—Thomas R. Savoie; Thomas A. Marcoux

[57] ABSTRACT

An easy-open beverage container and opening system therefor includes an opening provided in a barrier wall. Covering the opening is a tamper-evident pull tab having a holding portion and a topmost free end portion. An adhesive adheres the holding portion to an outside surface of the barrier wall so that the hole is sealed. A pair of slits is provided in the holding portion at opposite lateral edges of the holding portion adjacent the free end portion and the respective slits extend inwardly and downwardly away therefrom. The consumer grasps and pulls the non-adhered free end portion downwardly toward an opposite end of the holding portion to expose the opening. This causes a peeled part of the holding portion initially to be pulled from the barrier wall until the slits are reached; at which time the peeled part laterally separates from a remainder of the holding portion initially along the slits and then further along tear lines beginning at the lowermost ends of the slits to expose the opening. Preferably, the adhesive includes a first-strength adhesive and a second-strength adhesive having a strength greater than the first-strength adhesive so that when the peeled part tears downwardly along the tear lines, the tearing force required increases when the peeled part reaches the second-strength adhesive and the consumer can stop peeling at that point so that the peeled part remains attached to the remainder of the holding portion.

12 Claims, 1 Drawing Sheet

PULL TAB OPENING SYSTEM FOR BEVERAGE CONTAINER

FIELD OF THE INVENTION

The present invention relates generally to beverage containers which have an opening through which the beverage is consumed and more particularly to a bag-shaped beverage container having a pull tab opening system for the hole through which a straw is inserted to access the beverage.

BACKGROUND OF THE INVENTION

In bag-shaped (flexible pouch) beverage containers having a membrane seal which is to be pierced by a pointed straw, such as CAPRI SUN®, these containers include a preperforation extending up to an inner layer, such as the inner layer of the multi-layer web material forming the container. The inner layer, typically a barrier material, such as a metal foil, constitutes the aforementioned membrane seal. The piercing of the membrane seal may be an especial problem for small children who frequently utilize such containers and who lack the dexterity of adults.

The prior art discloses another opening system which includes a simple membrane seal on an inside surface of one barrier wall of a bag-shaped container. The membrane seal is sealed up to the edges of a straw hole which is prepunched through all layers of the barrier wall at a location near a top of the container. Such a membrane seal is disclosed in U.S. Pat. No. 5,425,583 (Wild). While such a membrane seal is mostly satisfactory, it is often difficult for young children (ages 4–9) to use since the membrane must be struck with the straw only at the hole in the barrier wall and at the same time with somewhat of a downward angle so that the straw does not also pierce the back barrier wall of the container. In addition, as the membrane is pierced, squeezing of the bag-shaped container to hold the container steady during piercing may result in the beverage being pushed up around the outside of the straw and out of the straw hole causing undesired spillage.

A complex and costly opening system using two distinct membrane seals for a bag-shaped container is disclosed in U.S. Pat. No. 4,553,693 (Terajima et al.). A first membrane seal is attached on the inside surface of the barrier wall about the straw hole and to a peelable tab attached to an outer surface of the barrier wall. Covering the first membrane and attached to the inside surface about the first membrane is a second membrane which is at least partially pierced. When the tab is peeled from the barrier wall, the part of the first membrane covering the straw hole is also peeled away therewith. This exposes the second membrane which is easily pierced by the straw, as it is already at least partially pierced. The tab, if not properly disposed by the consumer, will become environmental litter.

Various pull tabs opening systems have also been disclosed for containers such as shown in U.S. Pat. No. 4,244,474 (Wise), U.S. Pat. No. 4,679,693 (Forman), and U.S. Pat. No. 4,838,429 (Fabisiewicz et al.).

SUMMARY OF THE INVENTION

In accordance with the present invention, an easy-open beverage container and opening system therefor are provided in which a beverage in the container is designed to be consumed through an opening in the container. The beverage container may includes a first (or front) barrier wall and a second (or rear) barrier wall facing the first barrier wall. A hole is provided in the first barrier wall adjacent a top of the container through which a straw may be inserted to consume the beverage. An easy-open tamper-evident pull tab securely covers the hole until the consumer is ready to consume the beverage. This pull tab has a holding portion which is suitable for gripping by the fingers of the consumer. An attaching means releasably attaches the holding portion of the pull tab to an outside surface of the first barrier wall so that the hole is securely sealed by an overlying part of the holding portion and the surrounding attaching means. A pair of slits is provided in the holding portion, which slits begin at opposite lateral edges of the holding portion adjacent the free end portion and extend inwardly from the respective the lateral edge downwardly away from the free end portion.

When the consumer is ready to consume the beverage in the container, the consumer grasps and pulls the free end portion, which is not attached to the first barrier wall, downwardly toward an opposite end of the holding portion to expose the hole. This causes a peeled part of the holding portion initially to be peeled or pulled from the first barrier wall until the slits are reached at about the middle of the straw hole; after which the peeled part laterally separates from a remainder of the holding portion initially along the downwardly angled slits and then further along tear lines beginning at the lowermost ends of the slits. This peeling action of the peeled part ultimately exposes the hole underneath the holding portion.

In accordance with a preferred embodiment of the present invention, the holding portion includes a central part which overlies the hole on which the attaching means is preferably not provided. In addition, the attaching means includes adhesive segments of different holding strengths: a first-strength adhesive provided from adjacent the free end portion above the hole to below the hole; and a second-strength adhesive, having a strength greater than that of the first-strength adhesive, which extends from an end of the first-strength adhesive to a lower end of the holding portion. Thus, when the peeled part of the holding portion tears downwardly along the tear lines, the tearing force required increases when the peeled part reaches the second-strength adhesive and the consumer can stop peeling at that point so that the peeled part remains attached to the remainder of the holding portion.

In the preferred embodiment, the slits terminate at a position on opposite lateral sides of the hole, and the slits are angled to intersect at a point below the hole and opposite from the free end portion. Further, for ease of initial manufacture, the adhesive is present on the free end portion of the pull tab, and the pull tab then further includes a backing which covers the adhesive on the free end portion so that the adhesive present at the free end portion can not adhere to the first barrier wall. This backing could be either a plastic or paper material. Alternatively, instead of a separate backing, a top portion of the free end could be folded over and adhered to itself to provide the free end portion.

It is an object of the present invention to provide a simple-to-manufacture and simple-to-apply sealing member for a beverage container.

It is also an object of the present invention to provide an easy-open pull tab on a beverage container, which pull tab is easily left attached to the beverage container after the straw hole is exposed.

It is a further object of the present invention to provide a pull tab having slits therein which make pulling of the pull tab to expose the straw hole an easy task and which thus reduces spilling of the beverage during opening of the pull tab.

It is another object of the present invention to provide a pull tab which requires tearing to open, so that the opening system is thus tamper-evident should the pull tab be pulled far enough to access the straw hole.

Other features, advantages and objects of the present invention are stated in or apparent from the detailed description of a presently preferred embodiment of the invention found hereinbelow. Although the insertion is described for application to flexible pouch or bag-shaped containers, the invention is readily adapted to rigid containers, such as juice cans, which have top openings covered by a pull tab opening system.

DESCRIPTION OF THE PREFERRED EMBODIMENT

Figure 1:
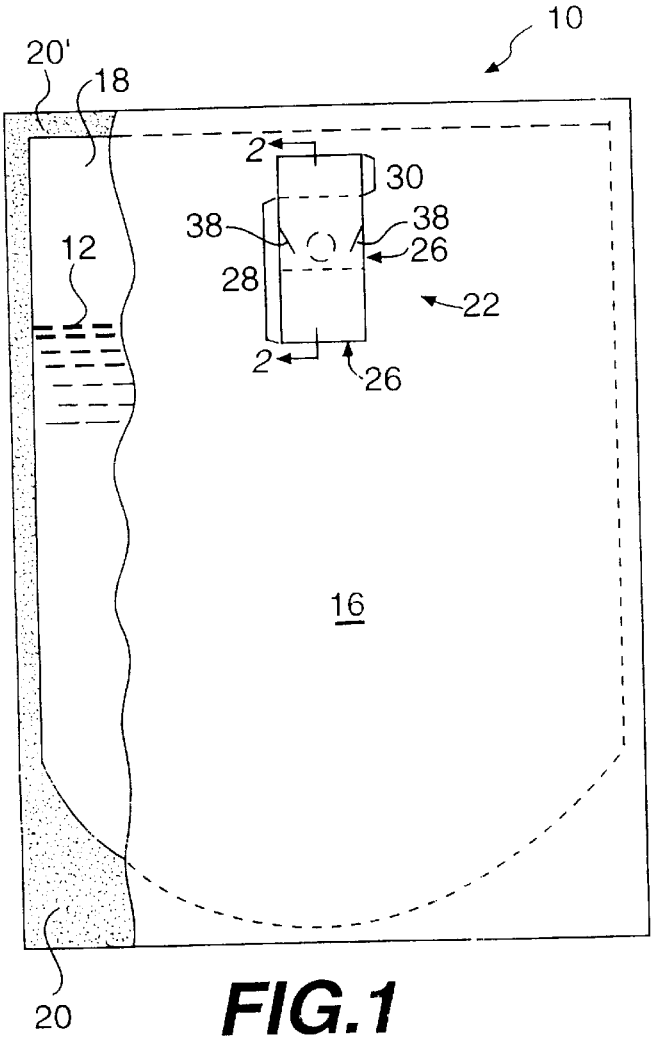
FIG. 1 is a front view of a beverage container with an easy-open pull tab according to the present invention with a left side portion of a front barrier wall of the beverage container cut away.

With reference now to the drawings in which like numerals represent like elements throughout the views, an easy-open and tamper-evident beverage container 10 in which a beverage 12 is contained is depicted in FIG. 1. Beverage 12 is designed to be consumed from container 10 by use of a straw 14 inserted into container 10. Container 10 is conveniently a flexible pouch or bag-shaped type of container such as used for CAPRI SUN®, which includes a first or front barrier wall 16 which is depicted partially cut away to show a second or rear barrier wall 18 facing or opposite to first barrier wall 16. As appreciated by those in the art, prior to filling with beverage 12, barrier walls 16 and 18 are attached together by a suitable adhesive or heat sealed layer 20 depicted by stippling along the peripheral edges of the two lateral sides and bottom as shown. Beverage container 10, now in the form of an open bag, is then filled through the open top, after which the top edges are then similarly attached together with a similar layer 20'. As also appreciated by those in the art, barrier walls 16 and 18 are suitably formed either as a monomaterial or as a multi-layer compound material, both of which are well known.

In order to consume beverage 12 from container 10, an easy-open, tamper-evident opening system 22 is provided as part of first barrier wall 16. Opening system 22 includes a straw hole 24 provided in first barrier wall 16 adjacent a top of container 10 through which straw 14 is inserted into container 10 to consume beverage 12. Straw hole 24 may be backed by a this, easily-ruptured, plastic film layer 25 attached securely to an inside surface of first barrier wall 16 to reinforce the material of first barrier wall 16 after straw hole 24 is made (punched) and/or to prevent contact between beverage 12 and adhesive 32*a*. Opening system 22 also includes a pull tab 26 which is applied to first barrier wall 16 to close straw hole 24 prior to filling of container 10 with beverage 12.

Figure 2:
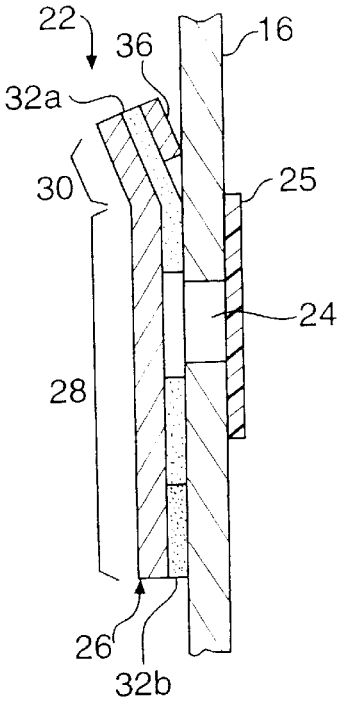
FIG. 2 is a cross-sectional elevation view of the pull tab and associated barrier wall of the beverage container taken along the line 2—2 in FIG. 1.

As shown best in FIG. 2, where the depicted thicknesses of the various elements have been exaggerated for clarity, pull tab 26 longitudinally includes a lower holding portion 28 and a topmost free end portion 30. An attaching means releasably or removably attaches holding portion 28 securely to an outside surface of first barrier wall 16 so that straw hole 24 is sealed by an overlying part of holding portion 28 and the surrounding attaching means. Preferably, holding portion 28 includes a central part 34 which is designed to overlie straw hole 24 on which attaching means is not provided, so that, even in the absence of a film layer 25, beverage 12 will not contact adhesive 32*a*.

The attaching means is preferably adhesives of which many are well known in the art. The adhesive is most preferably provided as two adhesive segments of different holding strengths. The first adhesive segment is a first-strength adhesive 32*a*, such as those adhesives used in the manufacturer of removable, pressure-sensitive labels, located longitudinally from adjacent free end portion 30 above straw hole 24 to a position below (or on an opposite side of) straw hole 24. The second adhesive segment is a second-strength adhesive 32*b*, such as those adhesives used in the manufacturer of permanent, paperfiber-tearing, pressure-sensitive labels, having a holding strength greater than first-strength adhesive 32*a*, extending longitudinally from where the first-strength adhesive 32*a* stops or ends to a lower (or opposite) end of holding portion 28. Conveniently for ease of manufacture of pull tab 26, and as previously noted, first-strength adhesive 32*a* extends all of the way to the top of free end portion 30, but at the top thereof a backing 36, such as a thin plastic or paper sheet covers (and is adhered to) first-strength adhesive 32*a* so that free end portion 30 does not adhere to first barrier wall 16.

Provided in holding portion 28 of pull tab 26 is a pair of weakened lines, preferably in the form of slits 38. Each respective slit 38 begins at an opposite lateral edge of holding portion 28 adjacent free end portion 30, and extends inwardly from the respective lateral edge and downwardly away from free end portion 30. Slits 38 terminate at a position on opposite lateral sides of straw hole 24 so that the lower and inner ends of slits 38 are spaced from straw hole 24. As shown in FIG. 1, slits 38 are angled downwardly toward an intersection point (but note slits 38 do not intersect) below straw hole 24.

Figure 3:
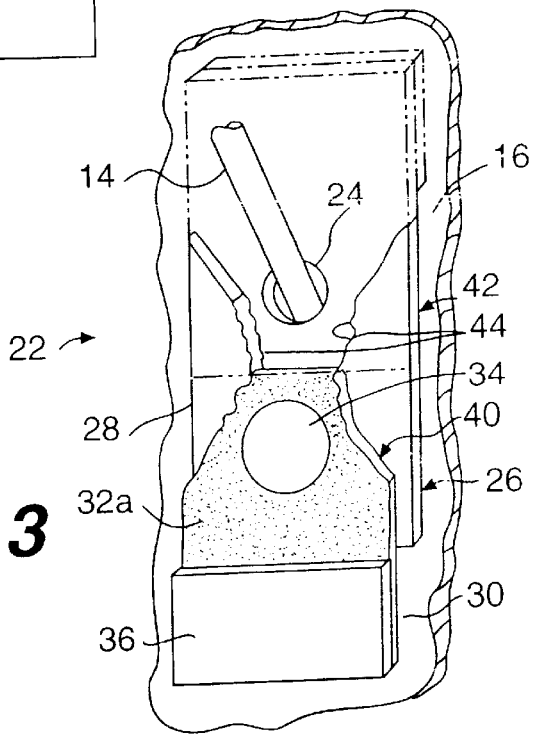
FIG. 3 is a front perspective view of the pull tab and associated barrier wall portion after the straw hole of the beverage container is exposed.

In operation, when the consumer desires to consume beverage 12 from container 10, the consumer grasps free end portion 30 of pull tab 26 (which is not adhered to first barrier wall 16 so that it is easily grasped) and pulls downwardly in order to peel a (to be) peeled part 40 of holding portion 28 from first barrier wall 16 to expose straw hole 24. This pulling of free end portion 30 occurs somewhat easily due to the designed peeling force required for first-strength adhesive 32*a*. As the peeling occurs, peeled part 40 of holding portion 28 is first pulled from first barrier wall 16 (as adhesive 32*a* is overcome) until slits 38 are reached. When slits 38 are reached, peeled part 40 laterally (and somewhat more easily) separates from a remainder 42 of holding portion 28 initially along slits 38 and then further (with some increased tearing resistance) along tear lines 44 which form in holding portion 28 as tearing of peeled part 40 from remainder 42 occurs due to the peeling force exerted by the consumer. Obviously, tear lines 44 begin at the downward and inward ends of slits 38, and tear lines 44 then extend further downwards (and more or less vertically but possibly with somewhat of a converging angle as shown) following the direction of the peeling force to fully expose straw hole 24 as shown in FIG. 3.

As peeled part 40 tears away from remainder 42 along tear lines 44, the peeling (and now tearing) force required increases significantly when peeled part 40 reaches second-strength adhesive 32*b* which has a greater holding strength than first-strength adhesive 32*a* initially encountered. As the consumer notices a significantly increased resistance to the peeling force exerted, the consumer typically then stops exerting the peeling or tearing force so that peeled part 40 remains attached to remainder 42 and hence to container 10. It will therefore be appreciated that by providing second (increased) strength adhesive 32*b*, peeled part 40 does not become litter or capable of being inadvertently swallowed by a young consumer. If excessive force is exerted by the consumer so that a portion of the pull tab detached from the container, the detached element may be adhered to a surface of container 10 due to the presence of pressure-sensitive adhesive 32*a*. Thus, again litter can be avoided.

As a deformation tearing of the peeled part 40 from first barrier wall 16 is unavoidable in order to expose straw hole 24, pull tab 26 thus exhibits tamper-evident, deformed tear lines 44 as straw hole 24 is exposed. Even if peeled part 40 is pressed back in place and held thereby by first adhesive 32*a* which remains at least somewhat sticky (so some reclosing of straw hole 24 by the consumer is possible if desired), the irregular and deformed tear lines 44 are still evident.

By designing the peeling strength of first-strength adhesive 32*a* appropriately (and less than second-strength adhesive 32*b*), a suitably secure non-leak seal is created for straw hole 24 which seal can still be easily overcome by the consumer. As the peeling strength is easily overcome, the consumer can also easily avoid spillage of beverage 12 from inside of beverage 10 as the relative easy peeling of peeled part 42 occurs and straw hole 24 is exposed.

While the present invention has been described with respect to an exemplary embodiment thereof, it will be understood by those of ordinary skill in the art that variations and modifications can be effected within the scope and spirit of the invention.

What is claimed is:

1. An opening system for a beverage container in which a beverage is consumed from inside the container through an opening comprising:

a barrier wall of the container, said barrier wall including a hole through which the beverage is consumed; and a pull tab having a holding portion and a free end portion, said pull tab including an attaching means for releasably attaching said holding portion of said pull tab to an outside surface of said barrier wall so that said hole is sealed by an overlying part of said holding portion and the surrounding said attaching means, a pair of slits provided in said holding portion of said pull tab, said slits beginning at opposite edges of said holding portion adjacent said free end portion and extending inwardly from the respective said opposite edge away from said free end portion such that, when the consumer pulls said free end portion which is not attached to said barrier wall toward an opposite end of said holding portion to expose said hole, a peeled part of said holding portion is first pulled from said barrier wall until said slits are reached at which time the peeled part laterally separates from a remainder of said holding portion initially along said slits and then further along tear lines beginning at the ends of said slits to expose said hole.

2. An opening system for a beverage container as claimed in claim 1 wherein said holding portion includes a central part which overlies said hole where said attaching means is not provided.

3. An opening system for a beverage container as claimed in claim 1 wherein said attaching means includes a first-strength adhesive provided from adjacent said free end portion on one side of said hole to an opposite side of said hole and a second-strength adhesive having a strength greater than said first-strength adhesive which extends from an end of said first-strength adhesive to an opposite end of said holding portion whereby when said peeled part of said holding portion tears along the tear lines the tearing force required increases when the peeled part reaches said second-strength adhesive.

4. An opening system for a beverage container as claimed in claim 1 wherein said slits terminate at a position on opposite lateral sides of said hole and said slits are angled to intersect at a point on a side of said hole opposite from said free end portion.

5. An opening system for a beverage container as claimed in claim 2 wherein said attaching means includes a first-strength adhesive provided from adjacent said free end portion on one side of said hole to an opposite side of said hole and a second-strength adhesive having a strength greater than said first-strength adhesive which extends from an end of said first-strength adhesive to an opposite end of said holding portion whereby when said peeled part of said holding portion tears along the tear lines the tearing force required increases when the peeled part reaches said second-strength adhesive.

6. An opening system for a beverage container as claimed in claim 5 wherein said slits terminate at a position on opposite lateral sides of said hole and said slits are angled to intersect at a point on a side of said hole opposite from said free end portion.

7. An easy-open beverage container in which a beverage therein is consumed through an opening comprising:

an opening provided in a barrier wall adjacent a top of the container through which the beverage is to be consumed;

an easy-open tamper-evident pull tab having a holding portion and a topmost free end portion, said pull tab including an attaching means for releasably attaching said holding portion of said pull tab to an outside surface of said barrier wall so that said hole is sealed by an overlying part of said holding portion and the surrounding said attaching means, a pair of slits provided in said holding portion of said pull tab, said slits beginning at opposite lateral edges of said holding portion adjacent said free end portion and extending inwardly from the respective said lateral edge downwardly away from said free end portion such that, when the consumer pulls said free end portion which is not attached to said barrier wall downwardly toward an opposite end of said holding portion to expose said hole, a peeled part of said holding portion is first pulled from said barrier wall until said slits are reached at which time the peeled part laterally separates from a remainder of said holding portion initially along said slits and then further along tear lines beginning at the ends of said slits to expose said hole.

8. An easy-open beverage container as claimed in claim 7 wherein said holding portion includes a central part which overlies said hole where said attaching means is not provided.

9. An easy-open beverage container as claimed in claim 7 wherein said attaching means includes a first-strength adhesive provided from adjacent said free end portion above said hole to below said hole and a second-strength adhesive having a strength greater than said first-strength adhesive which extends from an end of said first-strength adhesive to a lower end of said holding portion whereby when said peeled part of said holding portion tears downwardly along the tear lines the tearing force required increases when the peeled part reaches said second-strength adhesive.

10. An easy-open beverage container as claimed in claim 7 wherein said slits terminate at a position on opposite lateral sides of said hole and said slits are angled to intersect at a point on below said hole and opposite from said free end portion.

11. An easy-open beverage container as claimed in claim 8 wherein said attaching means includes a first-strength adhesive provided from adjacent said free end portion above said hole to below said hole and a second-strength adhesive having a strength greater than said first-strength adhesive which extends from an end of said first-strength adhesive to a lower end of said holding portion whereby when said peeled part of said holding portion tears downwardly along the tear lines the tearing force required increases when the peeled part reaches said second-strength adhesive.

12. An easy-open beverage container as claimed in claim 8 wherein said slits terminate at a position on opposite lateral sides of said hole and said slits are angled to intersect at a point on below said hole and opposite from said free end portion.

* * * * *